United States Patent [19]

Haku et al.

[11] Patent Number: 4,624,905

[45] Date of Patent: Nov. 25, 1986

[54] ELECTROPHOTOGRAPHIC PHOTOSENSITIVE MEMBER

[75] Inventors: Hisao Haku; Kazuyuki Goto; Masayuki Tanaka, all of Hirakata; Takeo Fukatsu, Uzi; Yukinori Kuwano, Katano, all of Japan

[73] Assignee: Sanyo Electric Co., Ltd., Osaka, Japan

[21] Appl. No.: 640,314

[22] Filed: Aug. 13, 1984

[30] Foreign Application Priority Data

Feb. 14, 1984 [JP] Japan ..... 59-26254
Feb. 14, 1984 [JP] Japan ..... 59-26255

[51] Int. Cl.[4] ..... G03G 5/082; G03G 5/14

[52] U.S. Cl. ..... 430/65; 430/67; 252/501.1; 357/2

[58] Field of Search ..... 430/57, 60, 65, 66, 430/67; 427/74; 252/501.1; 357/2

[56] References Cited

U.S. PATENT DOCUMENTS

| | | | |
|---|---|---|---|
| 4,414,319 | 11/1983 | Shirai et al. | 430/66 X |
| 4,465,750 | 8/1984 | Ogawa et al. | 427/74 X |
| 4,490,453 | 12/1984 | Shirai et al. | 430/65 |
| 4,501,807 | 2/1985 | Shirai et al. | 430/57 |
| 4,526,849 | 7/1985 | van der Voort et al. | 430/65 X |

*Primary Examiner*—Roland E. Martin
*Attorney, Agent, or Firm*—Stiefel, Gross, Kurland & Pavane

[57] ABSTRACT

An electrophotographic photosensitive member comprising a photoconductive layer formed over a substrate and a surface layer formed over the photoconductive layer and having a high photoconductivity and charge retaining ability at the surface layer, in which the photoconductive layer and the surface layer being composed chiefly of amorphous silicon, the surface layer being a layer containing a substance forming an insulating material as combined with the amorphous silicon, and the content of the substance based on the silicon atoms being low toward the substrate and high toward the surface of the surface layer; which is usable for copying machines and intelligent copying machines.

9 Claims, 10 Drawing Figures

ELECTROPHOTOGRAPHIC PHOTOSENSITIVE MEMBER

BACKGROUND OF THE INVENTION

1. Field of the Invention

The present invention relates to an electrophotographic photosensitive member including a photoconductive layer which is composed chiefly of amorphous silicon.

2. Description of the Prior Art

Electrophotographic photosensitive members which are composed chiefly of amorphous silicon are disclosed, for example, in U.S. Pat. Nos. 4,394,426, 4,359,514, 4,414,319, 4,418,132, 4,423,133, etc. Such photosensitive members have various advantages over those composed chiefly of selenium or cadmium sulfide in that they have higher resistance to heat and abrasion, are harmless and have higher photosensitivity. Furthermore these members have the advantage that they are usable for copying machines and intelligent copying machines including a laser printer become of sufficient sensitivity to light of long wavelengths.

When amorphous silicon is used for electrophotographic photosensitive members, the photoconductive layer must have a sufficient thickness so as to have a high dark resistivity and to obtain an amount of charges required for the developing process. The photosensitive member has a surface layer for preventing the flow of surface charges from the surface of the member into the photoconductive layer. The surface layer is made of a material composed chiefly of amorphous silicon and containing nitrogen, carbon or oxygen. When the surface layer contains a larger amount of such element, the surface layer is likely to have greater ability to retain the surface charges and enhanced surface strength but reduced photosensitivity.

Accordingly antinomic phenomena occur in that increased ability to retain the surface charges results in reduced photosensitivity whereas an improvement in the photosensitivity entails lower ability to retain surface charges. Thus, it has been impossible to improve both the photosensitivity and the charge retaining ability.

On the other hand, there is a need to block charges that would flow from the substrate into the photoconductive layer to thereby enable the surface of the photosensitive member to retain for an extended period of time the charges given thereto by corona discharge. Interposed between the substrate and the photoconductive layer for this purpose is a blocking layer for preventing flow of carriers (electrons in the case of positive charging or holes in the case of negative charging) from the substrate to the photoconductive layer and for permitting the carriers produced in the photoconductive layer by electromagnetic irradiation to flow into the substrate.

When the conventional photosensitive member is to be charged positively, the blocking layer is prepared from amorphous silicon with boron added thereto, while when the member is to be charged negatively, the blocking layer is prepared from amorphous silicon with phosphorus added thereto. The content of the boron or phosphorus is uniform in the direction of thickness of the blocking layer. Accordingly the layer has a flat energy level.

The higher the additive content of the blocking layer, the greater is the ability thereof to block carriers from the substrate, but the inflow of carriers from the photoconductive layer is then impeded to some extent resulting in lower photosensitivity. However, if the additive content of the blocking layer is low, carriers are likely to flow into the photoconductive layer from the substrate to decrease the charge retention period. Thus, the photosensitive member exhibits the antinomic properties, failing to retain charges for a prolonged period of time and have high photosensitivity.

SUMMARY OF THE INVENTION

The present invention provides an electrophotographic photosensitive member comprising a photoconductive layer formed over a substrate and a surface layer formed over the photoconductive layer, the layers being composed chiefly of amorphous silicon, the surface layer containing a substance forming an insulating material as combined with the amorphous silicon, the content of the substance based on the silicon atoms being low toward the substrate and high toward the surface of the member.

The electrophotographic photosensitive member of the present invention may further include a blocking layer between the substrate and the photoconductive layer. Preferably the blocking layer is composed chiefly of amorphous silicon and contains a substance for blocking the flow of carriers from the substrate into the photoconductive layer when combined with the amorphous silicon, the content of the substance being high toward the substrate and low toward the photoconductive layer.

DESCRIPTION OF THE PREFERRED EMBODIMENTS

Substrate

Figure 1:
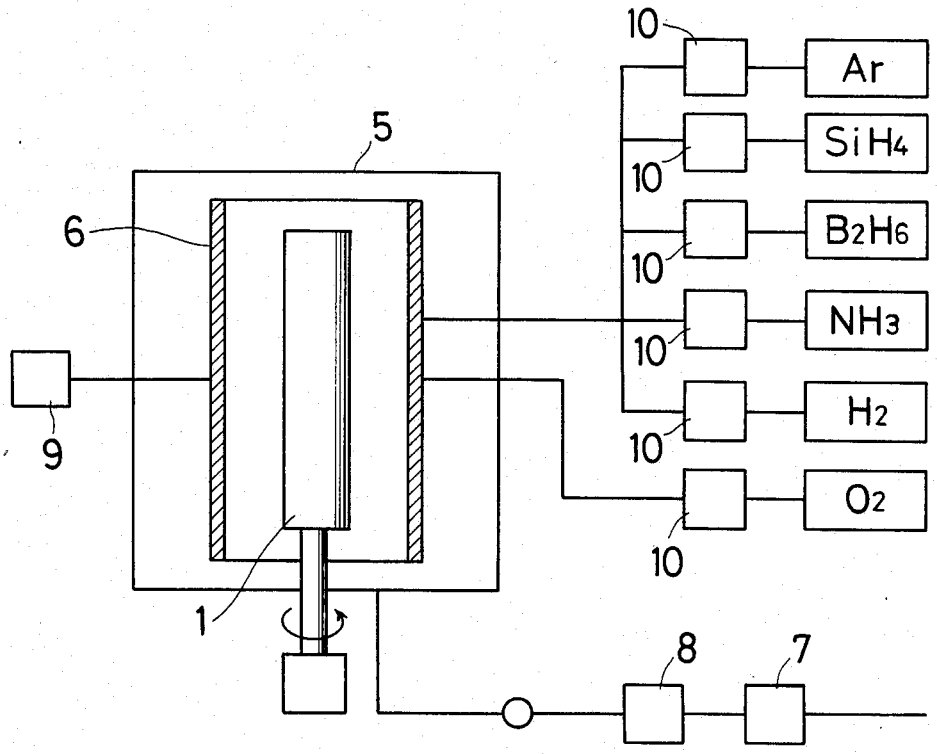
FIG. 1 is a diagram showing an example of an apparatus for preparing an electrophotographic photosensitive member of the present invention.

The substrate of the electrophotographic photosensitive member of the invention can be one which is already known in the art. Thus, it is usually in the form of a drum or belt. It is usually made of an electrically conductive material such as aluminum or stainless steel. The substrate made of the conductive material may be coated with a substance having a greater work function, such as Au, Cr, Cu, Ni, Pd, Pt, W, Mo, Ag or Ti, by vacuum evaporation or plating. The substrate may be coated with a substance, such as Co, Pb, Mo or W, which forms a silicide alloy with silicon. Although the substrate may of course be without any coating, it is then desired that the substrate have a surface polished, for example, to a roughness of up to 0.1 μm and/or be made of a highly purified conductive material, so as to be free from surface defects due to the presence of impurities.

Furthermore, the substrate may be a nonmetallic heat generating body of silicon carbide, boron oxide, aluminum nitride, alumina, boron nitride or the like which has a ground electrode. When such a substrate is used, the photosensitive member can be easily heated, for example, to 40° to 50° C. when it is to be used. This serves to prevent flow of images due to the condensation of water vapor on the photosensitive member.

Photoconductive layer

The photosensitive member of the present invention includes a photosensitive layer which is composed chiefly of amorphous silicon (hereinafter referred to as "a-Si"). The layer may be made chiefly of i-type a-Si, p-type a-Si (containing a Group III element added thereto) or n-type a-Si (incorporating a Group V element). The layer may be made of p-type a-Si at the substrate side thereof and n-type a-Si at the other side thereof adjacent the surface layer so as to have a high resistivity. Further in order to give a high resistivity to the layer, O, C, N or the like may be added to such a material. It is desirable to give the layer a resistivity of $10^9$ to $10^{12}$ ohm-cm and therefore to add impurities so as to afford such a resistivity. The amount of O to be added to give the desired resistivity is $2.5\times10^{19}$ to $1.5\times10^{22}$ atoms/cm$^3$. The corresponding amount of C or N is $5\times10^{21}$ to $4.5\times10^{22}$ atoms/cm$^3$. The layer may be formed from a-Si having added thereto as impurities a small amount of an organic compound which comprises a Group III element, such as $[(CH_3)_3Al]_2$, $(C_2H_5)_3Al$, $(CH_3)_3Ga$, $(C_2H_5)_3Ga$, $(C_2H_5)_3In$ or the like.

The preferred photoconductive layer is a p-type a-Si layer, n-type a-Si layer or high-resistivity layer. The layer must have a thickness sufficient to obtain an amount of charges required for the developing process. More specifically, the layer is usually about 5 to about 80 μm in thickness.

Surface layer

The surface layer, which is characteristic of the present invention, is provided primarily to prevent the charges provided on the free surface of the photosensitive member from flowing into the photoconductive layer and impairing the initial charge characteristics of the member. For this purpose, the layer is preferably a high-resistivity layer. The surface layer is composed chiefly of a-Si. To give a high resistivity to the layer, the a-Si has added thereto a substance which forms an insulating material when combined with the a-Si.

Useful substances for forming insulating materials are nitrogen, carbon and oxygen. $N_2$ gas, $NH_3$ gas or the like is used as the nitrogen source; $CH_4$, $C_2H_6$, $C_3H_8$ or like lower alkane as the carbon source; and $O_2$, $CO_2$ or like gas as the oxygen source. Such substances may be used in admixture.

The content of the substance based on the silicon atoms is low toward the substrate and high toward its surface. More specifically, the content is 0.01 to 30 atomic % toward the substrate and 1 to 90 atomic % toward its surface. The term "atomic %" means the number of atoms of the substance contained per 100 atoms of the silicon. Preferably, the content gradually increases from the substrate side toward the surface side. When having a higher content at the surface side, the surface layer possesses enhanced ability to retain surface charges (in other words, to prevent flow of charges into the photoconductive layer) and increased surface strength. On the other hand, the lower content at the substrate side serves to minimize the reduction of the photosensitivity.

The surface layer has a thickness of about 0.1 to about 20 μm, suitably about 0.1 to about 5 μ, preferably about 0.5 to about 1.5 μm. This thickness is much larger than that of coventional surface layers which is about 30 to about 1000 Å, i.e. about 0.003 to about 0.1 μm, so that the layer is easy to make. Accordingly the layer is unlikely to have variations in its thickness and is useful for giving uniform copy images. On the other hand, despite the large thickness, the carriers entering the surface layer are easily movable since the content of the insulation forming substance is lower at one side thereof adjacent the photoconductive layer. Further when the content is made to decrease from the free surface side of the surface layer toward the photoconductive layer, the carriers are movable with greater ease.

The surface layer may have incorporated therein a small amount of a Group III or V element or an organic compound containing Group III metal (see exmples given for the photoconductive layer) as impurities. The amount is usually $10^{-6}$ to $10^{-3}$ atomic %.

Blocking layer

Preferably the photosensitive member of the present invention has a blocking layer between the substrate and the photoconductive layer. The blocking layer has the function of preventing flow of carriers from the substrate into the photoconductive layer when the photosensitive member is charged and permitting the carriers produced by electromagnetic irradiation (as with light) in the photoconductive layer to move toward the substrate and flow into the substrate. The blocking layer can be prepared from a-Si to which boron or phosphorus is added. Usually $B_2H_6$ gas is used as the boron source, and $PH_3$ gas as the phosphorus source. Boron or phosphorus combines with the a-Si, forming a material for preventing flow of carriers from the substrate into the photoconductive layer. The boron source is used for forming the carrier blocking material when the photosensitive member is to be charged positively, or the phosphorus source is used for the same purpose when the member is to be charged negatively. We have found it preferable to make the content of the additive high toward the substrate and low toward the photoconductive layer. More specifically the additive content based on the Si atoms is $10^3$ to $10^5$ atomic ppm toward the substrate and 10 to $10^3$ atomic ppm toward the photoconductive layer. Preferably the content has a gradient. The layer of the above structure facilitates movement of carriers which tend to flow toward the substrate while preventing carriers from moving from the substrate toward the photoconductive layer. This serves to preclude the reduction of the photosensitivity.

The blocking layer is about 0.05 to about 1 μm in thickness. The blocking layer can be a silicide layer of $CoSi_2$, $Pb_2Si$, $MoSi_2$, $WSi_2$ or the like, or a hetero element of $Cu_2O$, PbO, FeO, NiO, GaP, InP, GaAlAs or the like.

According to the invention, the blocking layer, the photoconductive layer and the surface layer can be formed over the substrate by the CVD, PVD, spattering or like known process with use of a known apparatus. However, for forming the blocking layer over the substrate and the surface layer over the photoconductive layer, it is desirable to treat the substrate surface and the photoconductive layer surface with plasma in an Ar, $H_2$, $NH_3$ or like gas atmosphere to assure improved adhesion and to reduce electron traps at the interface.

EXAMPLES I to V and COMPARATIVE EXAMPLES I and II

A process for fabricating electrophotographic photosensitive members will be described with reference to the following examples. FIG. 1 shows a hollow cylindrical closed container 5 internally equipped with a hollow cylindrical electrode 6. An aluminum substrate 1 having a superfinished surface for making a photosensitive member is rotatably inserted into the electrode 6.

(Formation of blocking layer)

With the substrate 1 thus mounted in place, the interior of the container 5 is evacuated to a vacuum of about $1\times10^{-6}$ atm. by a rotary pump 7 and a mechanical booster pump 8. The substrate is thereafter heated to 200° to 300° C. by an unillustrated heater (inserted in the substrate 1) while being rotated at 10 r.p.m. Next, Ar gas is introduced into the closed container 5 at a flow rate of 200 c.c./min., and glow discharge is caused to occur across the electrode 6 and the substrate 1 for pre-treatment. Subsequently the Ar gas is evacuated from the container 5, into which $B_2H_6$ gas is then admitted along with $SiH_4$ gas and $H_2$ gas which are bases, to maintain the container 5 at a gas pressure of $1\times10^{-3}$ atm. The ratio of $B_2H_6$ gas to $SiH_4$ gas to be mixed therewith is controlled to a specified value by the corresponding mass flow controllers 10. However, the supply of $B_2H_6$ is decreased gradually. In this state, high-frequency power having a frequency of 13.56 MHz is applied to the substrate by a radio-frequency source 9 to cause plasma discharge. In a given period of time, a blocking layer 2 is formed over the substrate 1.

(Photoconductive layer)

After removing the gas mixture from the closed container 5, a specified quantity of $O_2$ gas is introduced into the container along with the above-mentioned gases, followed by the same discharge as above, whereby a photoconductive layer 3 is formed over the blocking layer 2.

(Formation of surface layer)

The gas mixture is then removed from the closed container 5, into which $SiH_4$ gas, $H_2$ gas and $NH_3$ gas are thereafter introduced in a specified ratio to cause discharge. $NH_3$ gas is supplied at a rate gradually increasing with time as controlled by the corresponding mass flow controller 10, whereby a surface layer 4 is formed.

Figure 2:
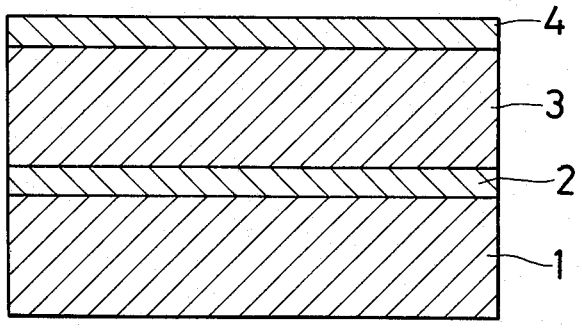
FIG. 2 is a diagram showing an embodiment of a photosensitive member of the invention.

In this way, a photosensitive member is obtained which has the structure shown in FIG. 2. As Examples I to V and Comparative Examples I and II, photosensitive members were prepared by the above process under varying conditions as listed in Table 1.

TABLE 1

| Example | Layer | | $SiH_4$ (cc/min) | $B_2H_6/SiH_4$ (ppm) | $O_2/SiH_4$ | $H_2/SiH_4$ | $NH_3/SiH_4$ | Thickness of layer (μm) |
|---|---|---|---|---|---|---|---|---|
| I | | Start | 100 | 5000 | 0 | 1.0 | 0 | |
| | Blocking layer | | | | | | | 1.0 |
| | | End | 100 | 500 | 0 | 1.0 | 0 | |
| | Photoconductive layer | | 300 | 20 | 0.01 | 0.2 | 0 | 20 |
| | | Start | 100 | 0 | 0 | 1.0 | 0.2 | |
| | Surface layer | | | | | | | 1.0 |
| | | End | 50 | 0 | 0 | 2.0 | 2.8 | |
| II | | Start | 100 | 5000 | 0 | 1.0 | 0 | |
| | Blocking layer | | | | | | | 1.0 |
| | | End | 100 | 500 | 0 | 1.0 | 0 | |
| | Photoconductive layer | | 300 | 20 | 0.01 | 0.2 | 0 | 20 |
| | | Start | 100 | 0 | 0 | 1.0 | 0.2 | |
| | Surface layer | | | | | | | 1.0 |
| | | End | 35 | 0 | 0 | 3.0 | 4.0 | |
| III | | Start | 100 | 5000 | 0 | 1.0 | 0 | |
| | Blocking layer | | | | | | | 1.0 |
| | | End | 100 | 500 | 0 | 1.0 | 0 | |
| | Photoconductive layer | | 300 | 20 | 0.01 | 0.2 | 0 | 20 |
| | | Start | 100 | 0 | 0 | 1.0 | 0.2 | |
| | Surface layer | | | | | | | 0.5 |
| | | End | 50 | 0 | 0 | 2.0 | 2.8 | |
| IV | | Start | 100 | 5000 | 0 | 1.0 | 0 | |
| | Blocking layer | | | | | | | 1.0 |
| | | End | 100 | 500 | 0 | 1.0 | 0 | |
| | Photoconductive layer | | 300 | 20 | 0.01 | 0.2 | 0 | 20 |
| | | Start | 100 | 0 | 0 | 1.0 | 0.2 | |
| | Surface layer | | | | | | | 1.0 |
| | | End | 100 | 0 | 0 | 1.0 | 1.4 | |
| V | Blocking layer | | 100 | 1000 | 0 | 1.0 | 0 | 1.0 |
| | Photoconductive layer | | 300 | 20 | 0.01 | 0.2 | 0 | 20 |
| | | Start | 100 | 0 | 0 | 1.0 | 0.2 | |
| | Surface layer | | | | | | | 1.0 |
| | | End | 50 | 0 | 0 | 2.0 | 2.8 | |
| Comp. Ex. I | Photoconductive layer | | 300 | 20 | 0.01 | 0.2 | 0 | 20 |
| Comp. Ex. II | Blocking layer | | 100 | 1000 | 0 | 1.0 | 0 | 1.0 |
| | Photoconductive layer | | 300 | 20 | 0.01 | 0.2 | 0 | 20 |
| | Surface layer | | 50 | 0 | 0 | 2.0 | 2.8 | 0.05 |

The photosensitive members (drums) obtained were tested for the evaluation of performance.

(Test methods)

(i) Variations in the amount of charges

The photosensitive drum is subjected to corona discharge under specified conditions, and the surface potentional (amount of charges) on the drum is measured by a surface potentiometer (TREK MODEL 344). The variations in the potential values along the length of the drum are expressed in percentage, with the mean value taken as 1.

(ii) Copying test

The photosensitive drum is installed in a copying machine and used for making copies to check the number of copies that can be produced without blurring images.

(iii) Temperature-humidity cycle test

The photosensitive drum is subjected to temperature-humidity cycles under conditions involving an upper limit of 60° C. and 90%, and a lower limit of −10° C. and the highest possible humidity that can be maintained. The time taken for one cycle is 1 hour for the upper limit, 2 hours for the change from upper limit to lower limit, 1 hour for the lower limit and 2 hours for the change from lower limit to upper limit, i.e. 6 hours in total. The drum is thus subjected to temperature-humidity cycles for 1000 hours, then heated in a constant-temperature chamber at 80° C. for 30 minutes and thereby conditioned uniformly for measurement, and thereafter checked for characteristics.

The results are shown in Table 2, which also indicates the energy band diagrams obtained for Examples I to V.

TABLE 2

Figure 3:
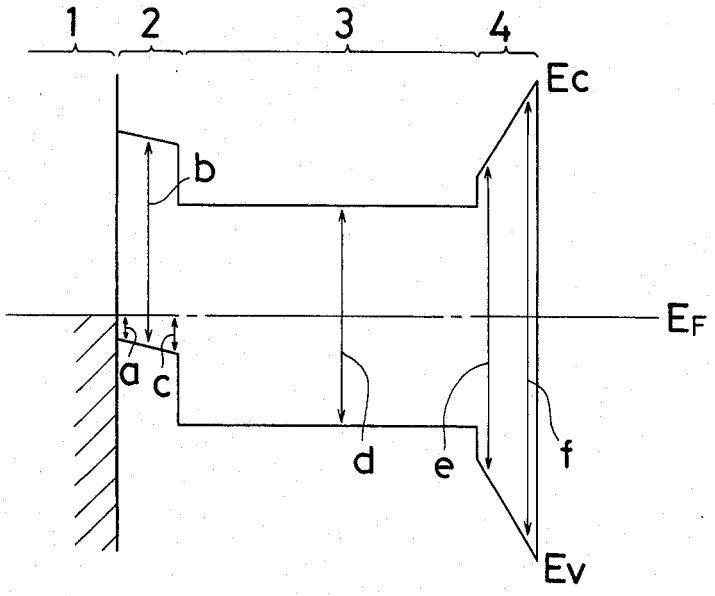
FIGS. 3 to 10 are energy band diagrams showing energy levels in the direction of thickness of photosensitive members embodying the present invention.
Figure 4:
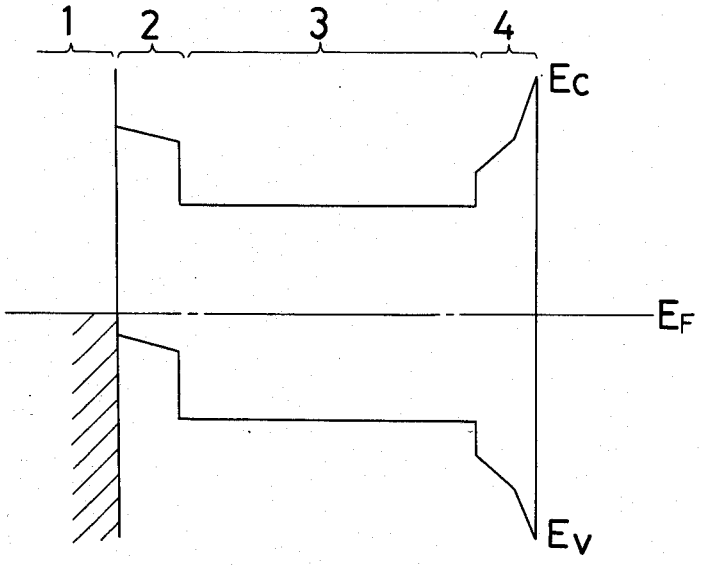
Figure 5:
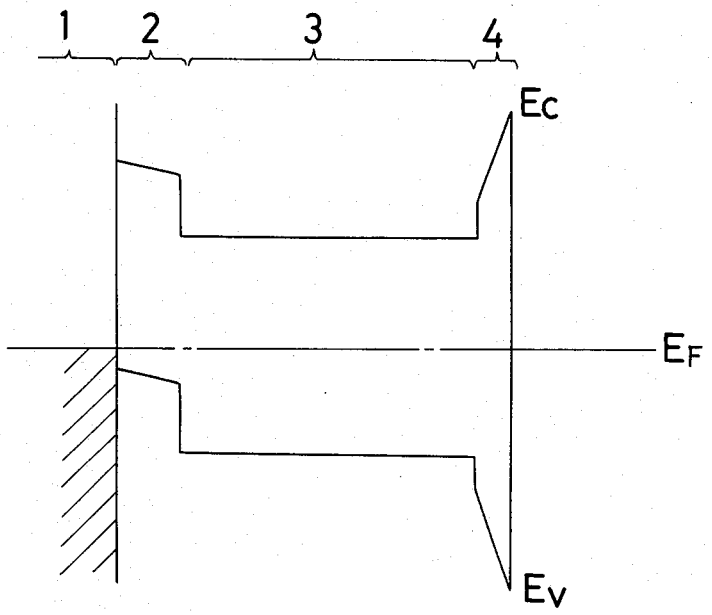
Figure 6:
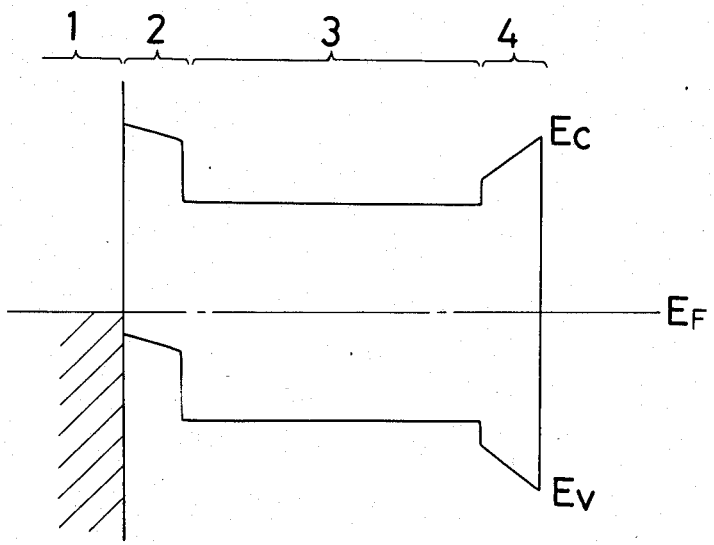
Figure 7:
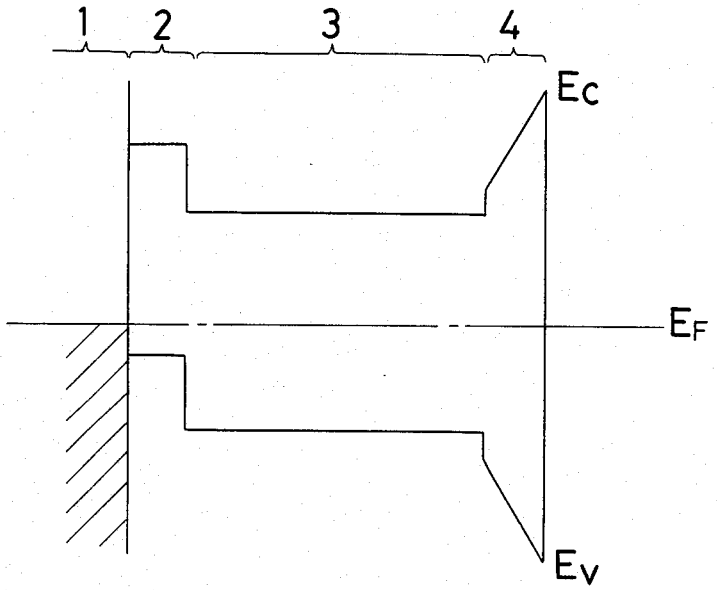

| Example | Variations in amount of charges | Copying test (No. of blurless copies) | Temp.-humidity cycle test | Energy band diagram |
|---|---|---|---|---|
| I | Within ±5% | 200,000 | Good | FIG. 3 |
| II | Within ±5% | 200,000 | Good | FIG. 4 |
| III | Within ±10% | 50,000 | Good | FIG. 5 |
| IV | Within ±5% | 50,000 | Good | FIG. 6 |
| V | Within ±5% | 100,000 | Good | FIG. 7 |
| Comp. Ex. I* | Within ±5% | 5,000 | Poor | — |
| Comp. Ex. II** | At least ±20% | 50,000 | Good | — |

Note
*Single-layer drum.
**Conventional three-layer drum.

In FIGS. 3 to 7, plotted as ordinate are energy levels in the case of positive charging. Indicated at $E_C$ is the conduction band, at $E_F$ the Fermi band, and at $E_V$ the valence band. The region indicated at 1 corresponds to the substrate, at 2 the blocking layer, at 3 the photoconductive layer, and at 4 the surface layer. In FIG. 3, the energy differences between $E_V$ and $E_F$ or between $E_V$ and $E_C$ are 0.2 eV for a, 1.75 ev for b, 0.3 eV for c, 1.8 ev for d, 2.4 eV for e, and 4.0 eV for f.

Thus the photosensitive members of Examples I to V are chargeable with reduced variations in the amount of charges and found to have outstanding characteristics by the copying test and temperature-humidity cycle test.

EXAMPLE VI

A blocking layer and a photoconductive layer were formed over a substrate under the same conditions as in Example I, and a surface layer was thereafter formed at stepwise varying $NH_3/SiH_4$ ratios as given below, whereby a photosensitive member was obtained. The $H_2/SiH_4$ ratio was the same as in Example I.

| Reaction time | | $NH_3/SiH_4$ |
|---|---|---|
| Initial period | (6 min.) | 0.2 |
| Intermediate period | (6 min.) | 1.4 |
| Final period | (8 min.) | 2.8 |

Figure 8:
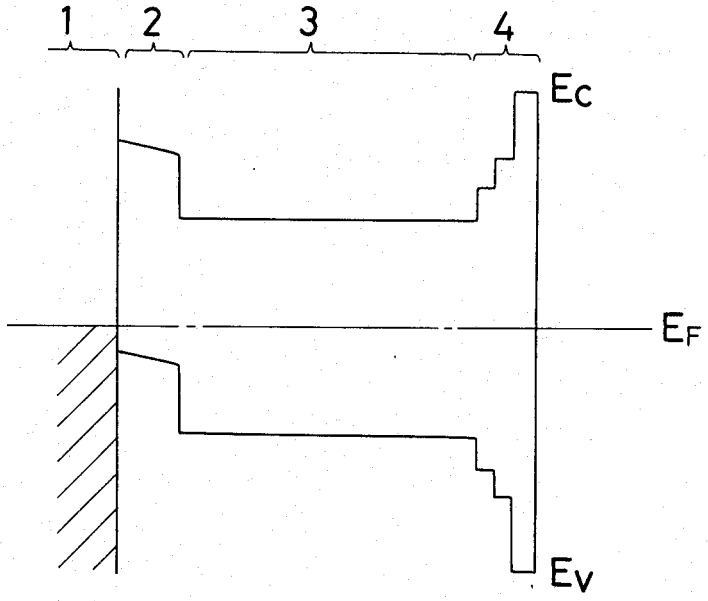

FIG. 8 is the energy band diagram of the photosensitive member thus obtained. The stepwise gradient pattern of $NH_3/SiH_4$ ratio was found to correspond to the energy level pattern of the surface layer.

The photosensitive member exhibited the same performance as the member obtained in Example I.

EXAMPLE VII

Figure 9:
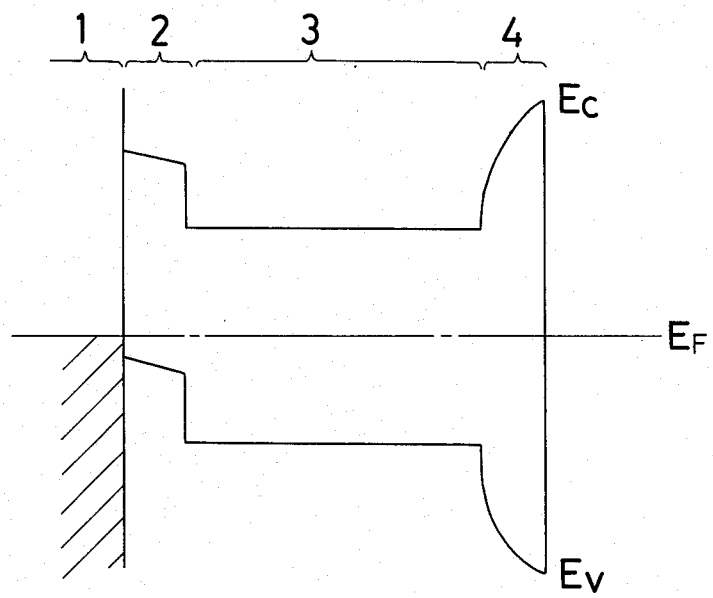

A photosensitive member was prepared in the same manner as in Example VI except that the gradient of $NH_3/SiH_4$ ratio was made to have an arcuate pattern. FIG. 9 is the energy band diagram of this member. The member exhibited the same performance as the one prepared in Example I.

EXAMPLE VIII

A photosensitive member was prepared in the same manner as in Example VI with the exception of varying the $NH_3/SiH_4$ as listed below.

| Reaction time | | $NH_3/SiH_4$ |
|---|---|---|
| Initial period | (6 min.) | 0.2 |
| Intermediate period I | (3 min.) | 0.2 → 0 |
| Intermediate period II | (3 min.) | 0 → 0.2 |
| Final period | (8 min.) | 0.2–2.8 |

Figure 10:
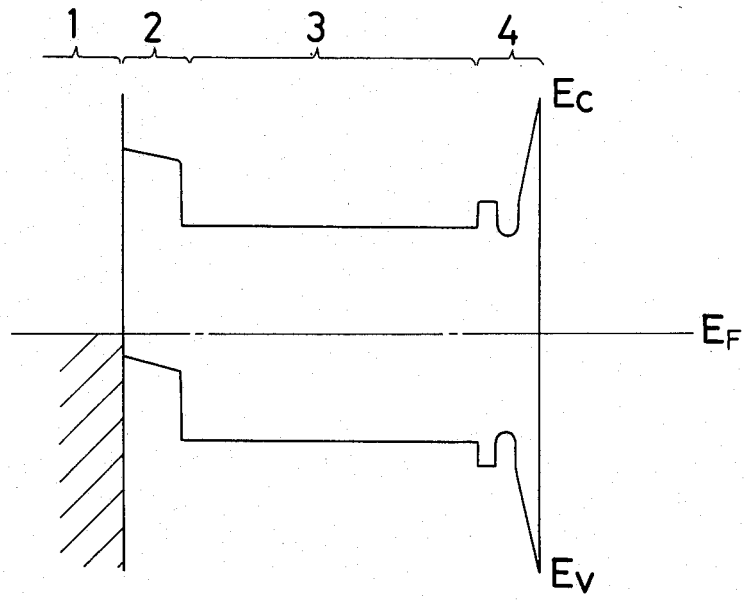

FIG. 10 is the energy band diagram of the member thus obtained. The member exhibited the same performance as the one prepared in Example I.

EXAMPLE IX

A blocking layer and a photoconductive layer were formed under the same conditions as in Example I, and a surface layer was thereafter formed under the same conditions as in Example I with the exception of additionally using $B_2H_6$ gas in an amount of 100 ppm based on the $SiH_4$ gas, whereby diminished dark decay was realized. This effect appears attributable to the presence of the small amount of boron acting to render the surface layer more intrinsic.

EXAMPLE X

A blocking layer and a photoconductive layer were formed under the same conditions as in Example I, and a surface layer was thereafter formed under the same conditions as in Example I except that the gas obtained by evaporating $(CH_3)_3Ga$ by the liquid bubbling method with use of $H_2$ as a carrier gas was additionally used in an amount of 1% based on the $SiH_4$ gas, whereby dark decay was diminished. This effect appears attributable to the presence of Ga acting as p-type silicon to render the surface layer more intrinsic.

EXAMPLE XI

A photosensitive member was prepared under the same conditions as in Example I except that the photoconductive layer was formed without using $B_2H_6$ gas but using the gas obtained by evaporating $(CH_3)_3Ga$ by the liquid bubbling method with use of $H_2$ as a carrier gas, in an amount of 0.2% based on the $SiH_4$ gas. Consequently diminished dark decay was realized. This effect appears attributable to the presence of Ga acting as p-type silicon to render the photoconductive layer more intrinsic.

EXAMPLE XII

A photoconductive layer and a surface layer were formed over a substrate under the same conditions as in Example I. The substrate was a hollow aluminum cylinder coated with chromium by electron beam vacuum evaporation. Although having no blocking layer, the photosensitive member obtained was comparable to the one prepared in Example V in respect of photoconductive characteristics and durability.

EXAMPLE XIII

A hollow stainless steel cylinder was coated with W by electron beam vacuum evaporation to obtain a substrate, which was further coated with an amorphous silicon film having a thickness of hundreds of angstroms. The surface of the substrate was then heated by a YAG laser to convert the silicon to W silicide. A photoconductive layer and a surface layer were thereafter formed over the substrate under the same conditions as in Example I.

The photoconductive layer was formed with greater bond strength than when an amorphous silicon layer is formed directly over stainless steel.

EXAMPLE XIV

A hollow stainless steel cylinder was coated with Mo by electron beam vacuum evaporation to obtain a substrate. Si ions were injected into the substrate which was heated at 400° C., followed by ion beam mixing to form Mo silicide. A photoconductive layer and a surface layer were thereafter formed over the substrate under the same conditions as in Example I.

The photoconductive layer was formed with greater bond strength than when an amorphous silicon layer is formed directly over stainless steel.

EXAMPLE XV

A photosensitive member was prepared under the same conditions as in Example I except that the substrate used was made of a nonmetallic heat generating material, i.e. silicon carbide, and lined with a metal (e.g. Al) coating.

The member was usable without the blur of images that could result from condensation of water vapor, when it was heated to 40° to 50° C. with application of low voltage.

EXAMPLE XVI

A photosensitive member was prepared under the same conditions as in Example I except that the substrate used was a hollow cylinder of aluminum having a high purity of at least 99.9% (A1090 according to JIS).

Because the substrate was made of high-purity aluminun and was freer from surface defects due to impurities (Fe, Cu, Si, Mn, Mg, etc.) in the aluminum, the amorphous silicon layers were formed with a reduced number of pinholes.

EXAMPLE XVII

A molybdenum silicide film was formed over a substrate by a radio-frequency spattering, using a target having an Mo/Si area ratio of 0.3 and heating the substrate at 200° C. A photoconductive layer and a surface layer were thereafter formed under the same conditions as in Example I.

The photosensitive member obtained had high bond strength and good durability although slightly inferior to those of other examples in blocking effect.

EXAMPLE XVIII

The surface of a hollow copper cylinder was subjected to thermal oxidation or oxygen plasma treatment to form a copper oxide film over the substrate surface. A photoconductive layer and a surface layer were thereafter formed under the same conditions as in Example I. Although having no blocking layer of amorphous silicon, the photosensitive member obtained had satisfactory blocking characteristics in addition to the advantages afforded by the present invention, owing to the presence of a hetero barrier between the copper oxide and the photoconductive layer.

EXAMPLE XIX

A GaP film was formed over a substrate by a plasma reaction in a gas mixture of $(CH_3)_3Ga$, P vapor and $(CH_3)_2Zn$. A photoconductive layer and a surface layer were thereafter formed under the same conditions as in Example I. The photosensitive member obtained had satisfactory blocking characteristics in addition to the advantages afforded by the present invention, owing to a hetero barrier present between the GaP and the photosensitive member.

EXAMPLE XX

A blocking layer and a photoconductive layer were formed over a substrate under the same conditions as in Example I, and the surface of the resulting amorphous silicon layer was treated with plasma in $NH_3$ gas. Without any interruption, a surface layer was thereafter formed under the same conditions as in Example I.

The photosensitive member obtained exhibited improved photosensitivity and a reduction in residual potential. These effects appear attributable to the plasma treatment in $NH_3$ resulting in diminished electron traps between the surface layer and the photoconductive layer.

What is claimed is:

1. An electrophotographic photosensitive member comprising:

(a) a substrate;

(b) a photoconductive layer superposed on the substrate, said layer comprising amorphous silicon having oxygen added thereto in an amount of from $2.5\times10^{19}$ to $1.5\times10^{22}$ atoms/cm$^3$ to increase its resistivity; and (c) a surface layer superposed on the photoconductive layer, the surface layer having a thickness in the range of from about 0.1 to 5 um and comprising amorphous silicon having added thereto nitrogen to form an insulating material therein, the concentration of nitrogen varying differentially from a minimum on the substrate side of the surface layer to a maximum on the surface side thereof.

2. A photosensitive member as defined in claim 1 wherein the content of the substance forming the insulating material based on the silicon atoms is 0.01 to 30 atomic % toward the substrate and 1 to 90 atomic % toward the surface of the surface layer.

3. A photosensitive member as defined in claim 1 wherein a Group III or Group V element is added as an impurity to the substrate forming the insulating material.

4. A photosensitive member as defined in claim 1 wherein metal ions obtained by decomposing on organic metal compound of a Group III element with plasma are added as an impurity to the substance forming the insulating material.

5. A photosensitive member as defined in claim 1 wherein a blocking layer is formed between the substrate and the photoconductive layer.

6. A photosensitive member as defined in claim 5, wherein the blocking layer comprises amorphous silicon and has boron or phosphorus incorporated therein for preventing flow of carriers from the substrate into the photoconductive layer.

7. A photosensitive member as defined in claim 6 wherein the content of the substance incorporated in the blocking layer is high toward the substrate and low toward the photoconductive layer.

8. A photosensitive member as defined in claim 6 wherein the content of the substance incorporated in the blocking layer is $10^3$ to $10^5$ atomic ppm toward the substrate and 10 to $10^3$ atomic ppm toward the photoconductive layer.

9. A photosensitive member as defined in claim 6, wherein the content of the boron or phosphorus incorporated in the blocking layer decreases gradually from the substrate side thereof toward the other side thereof.

* * * * *

UNITED STATES PATENT AND TRADEMARK OFFICE

CERTIFICATE OF CORRECTION

PATENT NO. : 4,624,905

DATED : November 25, 1986

INVENTOR(S) : Hisao Haku; Masayuki Tanaka; Takeo Fukatsu; Yukinori Kuwano

It is certified that error appears in the above-identified patent and that said Letters Patent are hereby corrected as shown below:

Column 1, line 22: "become" should read --because--.
Column 3, line 68: "5 μ" should read --5 μm--.
Column 7, line 53: "1.75 ev" should read --1.75 eV--.
Column 7, line 54: "1.8 ev" should read --1.8 eV--.
Column 10, line 56: "um" should read --μm--.

Signed and Sealed this

Fifteenth Day of September, 1987

*Attest:*

DONALD J. QUIGG

*Attesting Officer*

*Commissioner of Patents and Trademarks*